US011427977B2

(12) United States Patent
Owen et al.

(10) Patent No.: US 11,427,977 B2
(45) Date of Patent: Aug. 30, 2022

(54) BARRICADE

(71) Applicant: American Louver Company, Des Plaines, IL (US)

(72) Inventors: Robert Owen, Chicago, IL (US); Daniel Patrick Calby, Park Ridge, IL (US); Nabil Elhassan, Chicago, IL (US)

(73) Assignee: American Louver Company, Des Plaines, IL (US)

( * ) Notice: Subject to any disclaimer, the term of this patent is extended or adjusted under 35 U.S.C. 154(b) by 372 days.

(21) Appl. No.: 16/809,193

(22) Filed: Mar. 4, 2020

(65) Prior Publication Data

US 2021/0277614 A1 Sep. 9, 2021

(51) Int. Cl.
*E01F 13/02* (2006.01)
*E04F 11/18* (2006.01)

(52) U.S. Cl.
CPC ..... *E01F 13/022* (2013.01); *E04F 11/18* (2013.01)

(58) Field of Classification Search
CPC ..... E01F 13/022; E01F 9/70; E04F 11/18; E04H 17/18; E04H 17/185
See application file for complete search history.

(56) References Cited

U.S. PATENT DOCUMENTS

| | | | | |
|---|---|---|---|---|
| 5,419,065 | A * | 5/1995 | Lin | B60Q 7/00 40/550 |
| 6,199,833 | B1 * | 3/2001 | Bilby | E01F 9/70 256/67 |
| 6,257,559 | B1 * | 7/2001 | Mouri | E01F 9/70 256/25 |
| 7,540,682 | B1 * | 6/2009 | Christensen | E01F 13/022 116/63 P |
| 9,260,829 | B1 * | 2/2016 | Maus | E01F 13/022 |
| 9,624,630 | B1 * | 4/2017 | Maus | E04H 17/16 |
| 10,132,101 | B1 * | 11/2018 | Hongthong | E01F 13/022 |
| 10,683,624 | B2 * | 6/2020 | Whiteley | E01F 13/022 |
| 2002/0014619 | A1 * | 2/2002 | Christensen | E01F 9/70 256/25 |
| 2020/0018025 | A1 * | 1/2020 | Calby | E01F 13/02 |

* cited by examiner

*Primary Examiner* — Theodore V Adamos
(74) *Attorney, Agent, or Firm* — McDermott Will and Emery LLP

(57) ABSTRACT

Barricade systems are provided. A barricade system includes a first handle recess, a first channel extending to the first handle recess, a first handle portion including a first handle and a first handle post, and a first leg portion including a first leg and a first leg post. The first handle extends perpendicularly from one end of the first handle post. The first leg extends perpendicularly from one end of the first leg post. The first handle post and the first leg post are rotatably connected to each other. The rotatably connected first handle post and first leg post are disposed within the first channel. The barricade system switches between a stowed state and a deployed state by rotating the first handle post 180 degree. The 180 degree rotation of the first handle post facilitates a 90 degree rotation of the first leg post.

15 Claims, 10 Drawing Sheets

BARRICADE

TECHNICAL FIELD

This disclosure relates to a barricade system having a deployable support system.

BACKGROUND

Products that accommodate a wide variety of people including those with disabilities are desired. For products to be used by a wide variety of people, the products should be user-friendly and intuitive. For products to be used by a wider variety of people including those with disabilities, it is necessary to provide a barricade that is easily deployable and that minimizes the number of legs necessary for full deployment.

The present disclosure provides for user-friendly and intuitive barricade systems that are also designed to delineate pathways for those with disabilities. A full discussion of the features and advantages of the present disclosure is deferred to the following detailed description, which proceeds with reference to the accompanying drawings.

SUMMARY

According to certain aspects of the present disclosure, a barricade system is provided. The barricade system includes an upper side, a lower side disposed opposite the upper side, a first lateral side extending between the upper side and the lower side, a second lateral side extending between the upper side and the lower side, the second lateral side disposed opposite the first lateral side, a first surface extending between the first lateral side and the second lateral side, a second surface extending between the first lateral side and the second lateral side, the second surface disposed opposite the first surface, and a channel extending from the lower side toward the upper side, the channel including an opening at the lower side. The barricade system also includes a first handle recess disposed on the first surface and a first channel extending from an opening at the lower side toward the upper side to the first handle recess. The first channel is parallel with at least one of the first lateral side and the second lateral side. The barricade system further includes a first handle portion including a first handle and a first handle post, the first handle extending perpendicularly from one end of the first handle post and a first leg portion including a first leg and a first leg post. The first leg extends perpendicularly from one end of the first leg post. The first handle post and the first leg post are rotatably connected to each other. The rotatably connected first handle post and first leg post are disposed within the first channel. The barricade system switches between a stowed state and a deployed state by rotating the first handle post 180 degree. The 180 degree rotation of the first handle post facilitates a 90 degree rotation of the first leg post.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1A:
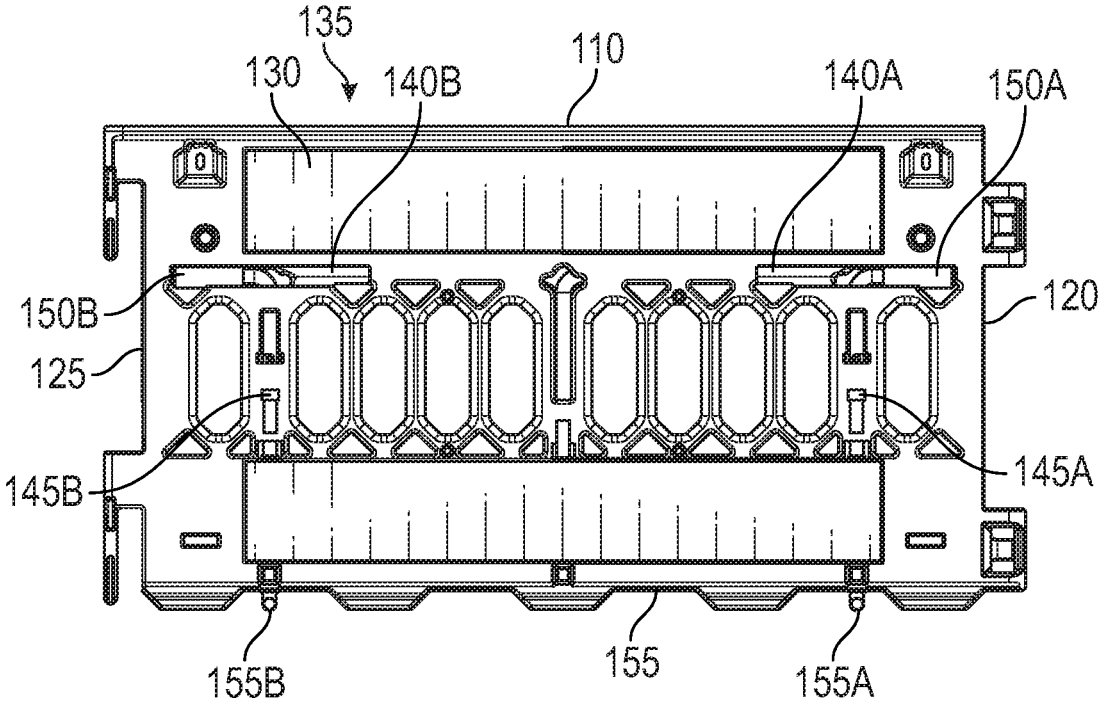
FIGS. 1A and 1B illustrate an example barricade system according to certain aspects of the disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

In addition, each of the drawings is a schematic diagram and thus is not necessarily strictly illustrated. In each of the drawings, substantially the same structural components are assigned with the same reference signs, and redundant descriptions will be omitted or simplified.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. For example, while the barricade systems discussed herein may be implemented in many different forms, the disclosure will show in the drawings, and will herein describe in detail, implementations with the understanding that the present description is to be considered as an exemplification of the principles of the selectively-configurable barricade system and is not intended to limit the broad aspects of the disclosure to the implementations illustrated. Accordingly, the drawings and description are to be regarded as illustrative in nature and not restrictive.

Example System Architecture

Figure 1B:
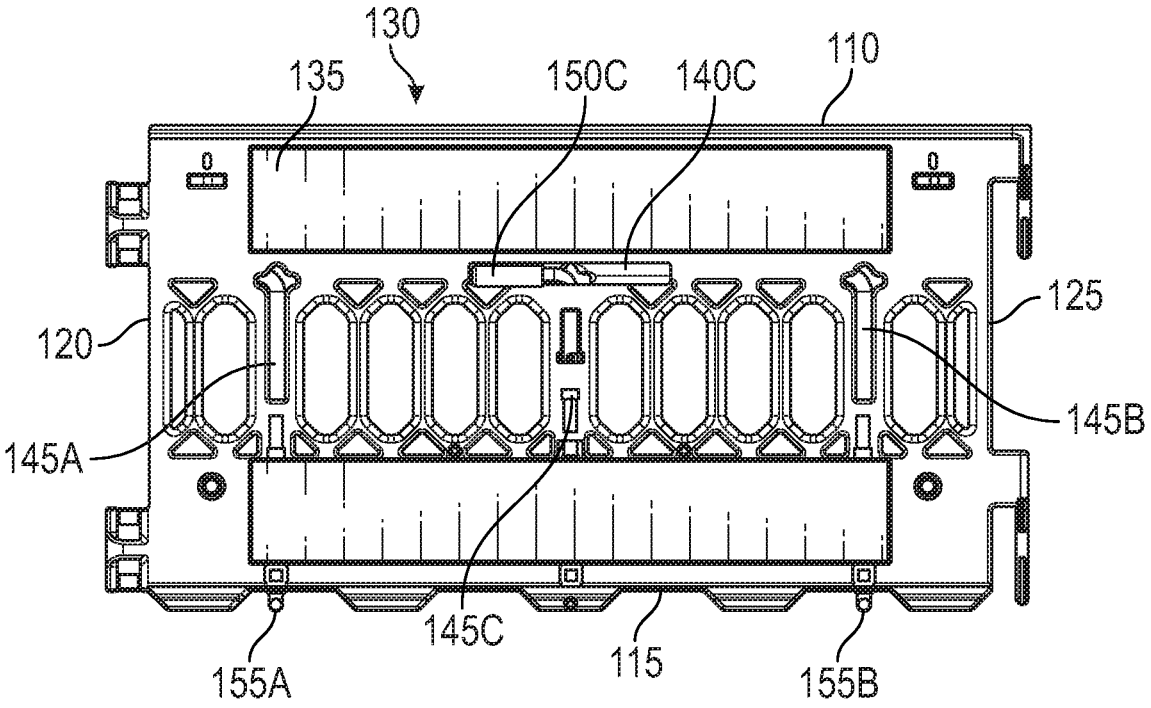

FIGS. 1A and 1B illustrate an example barricade system 100 according to certain aspects of the disclosure. The barricade system 100 includes an upper side 110, a lower side 115, a first lateral side 120, a second lateral side 125, a first surface 130, a second surface 135, three handle recesses 140A-140C, three channels 145A-145C, three handle portions 150A-150C, and three leg portions 155A-155C (155C not shown in FIGS. 1A and 1B). FIGS. 1A and 1B illustrate three handle recesses, three channels, three handle portions, and three leg portions provided in the barricade system 100, but the number of each type of the elements is not limited to three, and may be less or more than the numbers of the elements shown in FIGS. 1A and 1B. It is understood the dimensions of these elements are exemplary only, and other sizes and shapes are possible.

FIG. 1A illustrates an example barricade system 100 as viewed from the first surface 130. The upper side 110 is disposed opposite the lower side 115. The first lateral side 120 extends between the upper side 110 and lower side 115. The second lateral side 125 extends between the upper side 110 and the lower side 115. The second lateral side 125 is disposed opposite the first lateral side 120. The first surface 130 extending between the first lateral side 120 and the second lateral side 125. The second surface 135 extending between the first lateral side 120 and the second lateral side 125. The second surface 135 is disposed opposite the first surface 130.

The first surface 130 includes a first handle recess 140A and a second handle recess 140B. The first handle recess 140A may have an elongated shape that is parallel with the upper side 110 and the lower side 115. The first handle recess 140A is disposed between the upper side 110 and the lower side 115. The second handle recess 140B has a similar structure as that of the first handle recess 140A, and a detailed description of the second handle recess 140B thereof will be omitted. FIG. 1A illustrates the first handle recess 140A and the second handle recess 140B disposed the same distance from the upper side 110, but the distance is not limited to be the same, and the first handle recess 140A and the second handle recess 140B may be disposed at different distances from the upper side 110. The second surface 135 will be described later with respect to FIG. 1B.

A first channel 145A has an opening at the lower side 115. The first channel 145A extends from the lower side 115 toward the upper side 110 to the first handle recess 140A. The first channel 145A may be parallel with the first lateral side 120 and the second lateral side 125. The first channel 145A connects with the first handle recess 140A. The first channel 145A and the first handle recess 140A may be perpendicularly connected with each other. FIG. 1A illustrates the first channel 145A being connected to a mid-point of the first handle recess 140A in a longitudinal direction, but the connecting point is not limited to the mid-point of the first handle recess 140A in a longitudinal direction, and the connecting point may be anywhere in the first handle recess 140A. A second channel 145B has a similar structure as that of the first channel 145A, and a detailed description of the second channel 145B thereof will be omitted. A third channel 145C will be described later with respect to FIG. 1B.

FIG. 1A illustrates the first channel 145A being disposed closer to the first lateral side 120 that the second channel 145B, and the second channel 145B being disposed closer to the second lateral side 125 than the first channel 145A. FIG. 1A further illustrates the distance between the first channel 145A and the first lateral side 120 and the distance between the second channel 145B and the second lateral side 125 are equal to each other. In some embodiments, the distance between the first channel 145A and the first lateral side 120 and the distance between the second channel 145B and the second lateral side 125 may differ from one another. For example, the distance between the first channel 145A and the first lateral side 120 may be shorter than the distance between the second channel 145B and the second lateral side 125.

The first handle recess 140A and the first channel 145A accommodate a first handle portion 150A and a first leg portion 155A. The description of the first handle portion 150A and the first leg portion 155A will be made with respect to FIGS. 2A-2F.

Figure 2A:
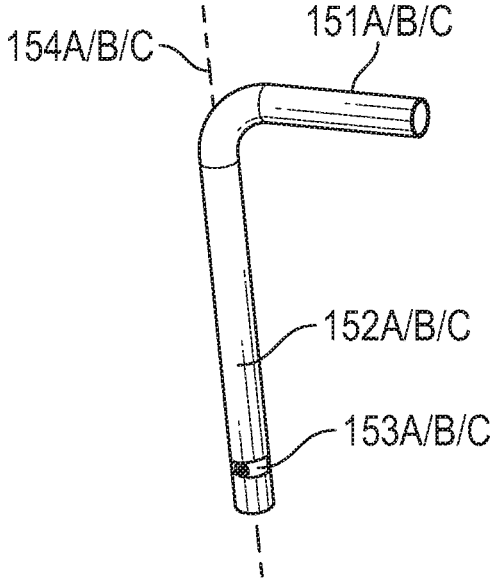
FIGS. 2A and 2B illustrate an example of the first handle portion according to certain aspects of the disclosure.
Figure 2B:
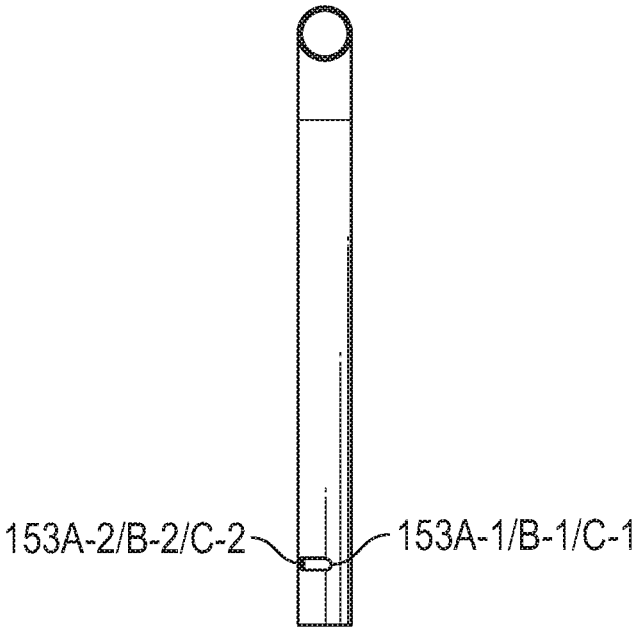

FIGS. 2A and 2B illustrate an example of the first handle portion 150A. As illustrated in FIG. 2A, the first handle portion 150A includes a first handle 151A, a first handle post 152A, and a first slit 153A. The first handle portion 150A may be a pipe having an L-shape such that the first handle 151A and the first handle post 152A are perpendicularly connected with each other. The first handle post 152A includes the first slit 153A. The first slit 153A is an opening on an outer surface of the first handle post 152A and has an elongated shape. The first slit 153A is provided on the first handle post 152A such that the longitudinal axis of the first slit 153A is perpendicular to the longitudinal axis of the first handle post 152A.

As illustrated in FIG. 2B, the first slit 153A has a first longitudinal end 153A-1 and a second longitudinal end 153A-2. The first longitudinal end 153A-1 of the first slit 153A is disposed on the outer surface of the first handle post 152A such that the first longitudinal end 153A-1 and an inner corner of the connecting point of the first handle 151A and the first handle post 152A can be connected with a first hypothetical straight line 154A that extends parallel with the longitudinal axis of the first handle post 152A. A distance between the first longitudinal end 153A-1 and the second longitudinal end 153A-2 covers one fourth of the circumference of the pipe-shaped first handle post 152A.

Figure 2D:
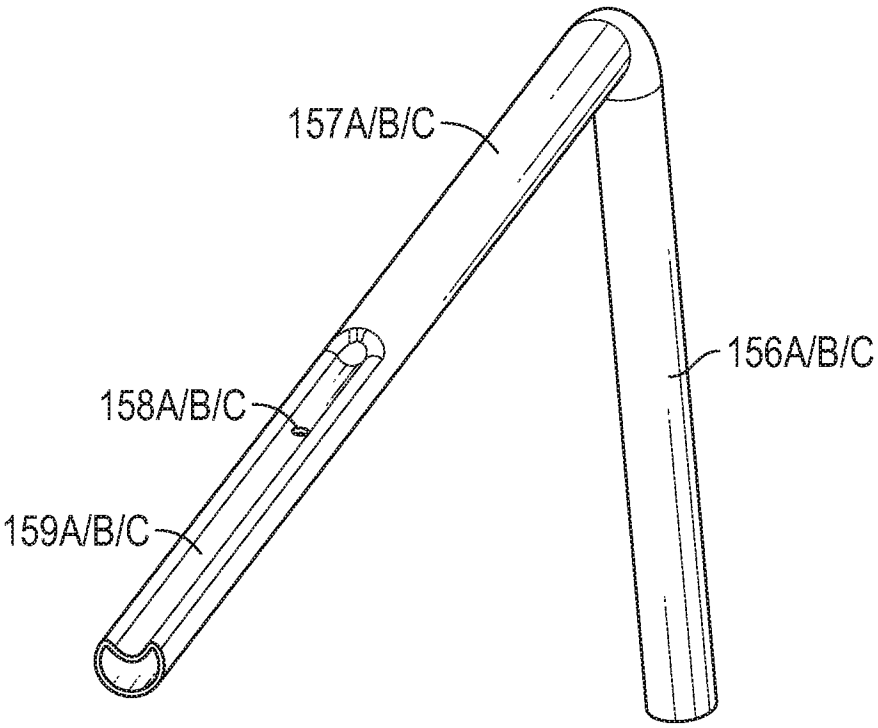
FIGS. 2C, 2D, and 2E illustrate an example of the first leg portion according to certain aspects of the disclosure.
Figure 2C:
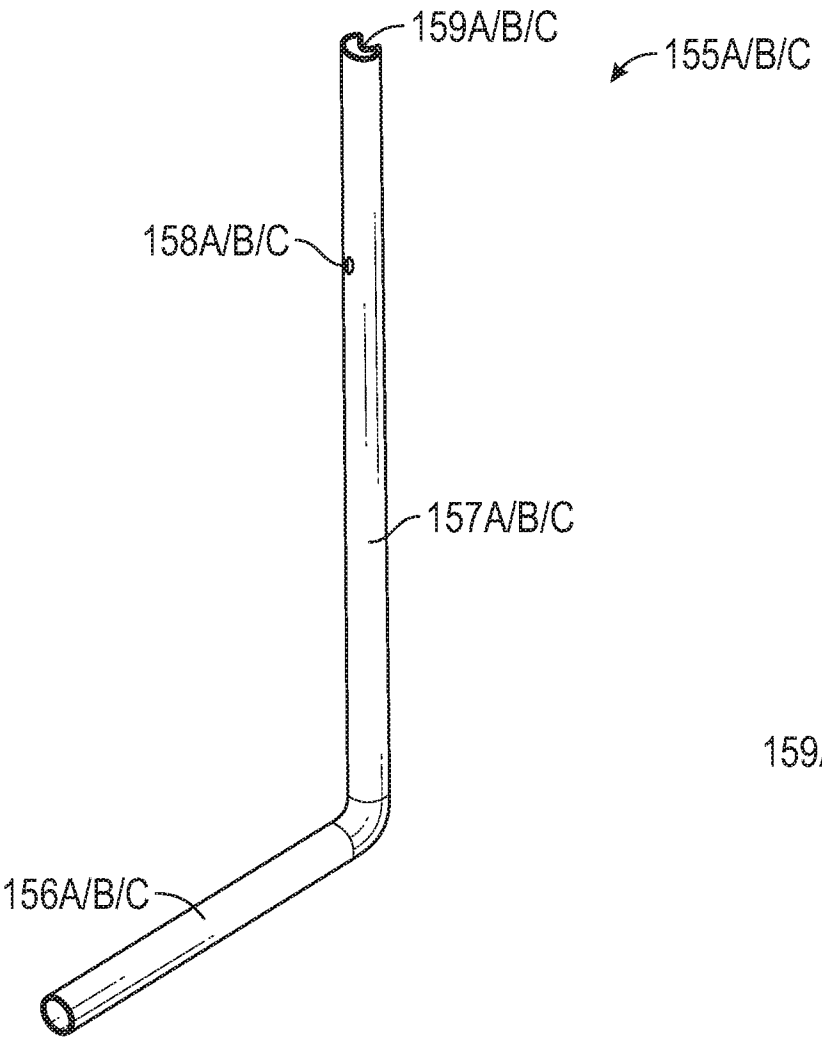
Figure 2E:
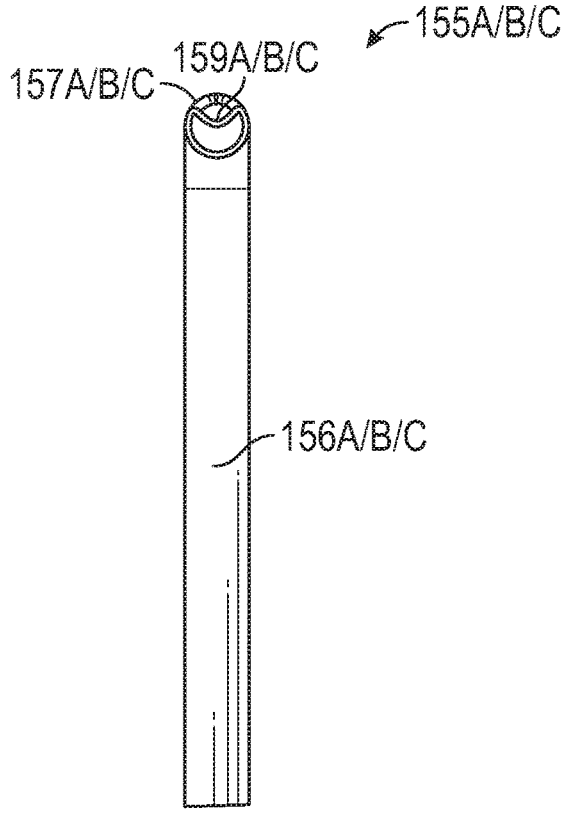

FIGS. 2C, 2D, and 2E illustrate an example of the first leg portion 155A. As illustrated in FIG. 2C, the first leg portion 155A includes a first leg 156A, a first leg post 157A, and a first hole 158A. The first leg portion 155A may be a pipe having an L-shape such that the first leg 156A and the first leg post 157A are perpendicularly connected with each other. The first leg post 157A includes the first hole 158A through which a screw (not shown) is inserted. The first hole 158A is a through-hole that perpendicularly crosses the longitudinal axis of the first leg post 157A. The first hole 158A is disposed on the outer surface of the first leg post 157A such that an axis of the first hole 158A is parallel with the longitudinal axis of the first leg 156A.

As illustrated in FIG. 2D, the first leg post 157A has a first crimp section 159A that extends along the longitudinal axis of the first leg post 157A from an end of the first leg post 157A towards the connecting point of the first leg 156A and the first leg post 157A. The first crimp section 159A is disposed on a portion of the outer surface of the first leg post 157A that is 180 degree opposite the portion of the outer surface of the first leg post 157A where the first leg 156A extends from. The first hole 158A is disposed on the first leg post 157A such that one opening of the first hole 158A (i.e., through-hole) is disposed on in the first crimp section 159A while the other opening of the first hole 158A is disposed on a portion of the outer surface of the first leg post 157A that faces the first leg 156A.

As illustrated in FIG. 2E, the first crimp section 159A is crimped to allow for a screw (not shown) used to mate the first handle portion 150A and the first leg portion 155B without interference between the screw and the first handle portion 150A.

Figure 2F:
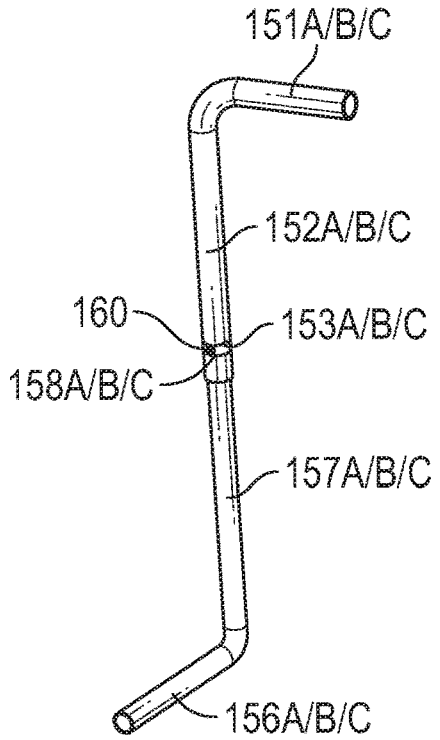
FIG. 2F illustrates an example assembly of the first handle portion and the first leg portion according to certain aspects of the disclosure.

FIG. 2F illustrates an example assembly of the first handle portion 150A and the first leg portion 155A. The circumference of the first handle post 152A is larger than the circumference of the first leg post 157A so that when the first handle portion 150A and the first leg portion 155A are mated, the first leg post 157A is rotatably fitted inside the first handle post 152A. When the first leg post 157A is rotatably fitted inside the first handle post 152A, the first slit 153A and the first hole 158A are aligned with one another, and a first screw 160A is inserted through the first slit 153A and the first hole 158A. The first screw 160A may be inserted from the first slit 153A through the first hole 158A to the first crimp section 159A. This configuration allows the first handle portion 150A to rotate 180 degrees while the first leg portion 155A rotates 90 degrees.

The first handle portion 150A and the first leg portion 155A have been described with respect to FIGS. 2A-2F. The second handle portion 150B and the third handle portion 150C are similarly structured as the first handle portion 150A, and a detailed description thereof will be omitted. That is, as illustrated in FIGS. 2A and 2B, the second handle portion 150B includes a second handle 151B, a second handle post 152B, a second slit 153B, and a second hypothetical straight line 154B, wherein the second slit 153B has a first longitudinal end 153B-1 and a second longitudinal end 153B-2. Further, as illustrated in FIG. 2A, the third handle portion 150C includes a third handle 151C, a third handle post 152C, a third slit 153C, and a third hypothetical straight line 154C, wherein the third slit 153B has a first longitudinal end 153C-1 and a second longitudinal end 153C-2.

The second leg portion 155B and the third leg portion 155C are similarly structured as the first leg portion 155A, and a detailed description thereof will be omitted. That is, as illustrated in FIGS. 2C, 2D and 2E, the second leg portion 155B includes a second leg 156B, a second leg post 157B, and a second hole 158B, wherein the second leg post 157B has a second crimp section 159B. Further, as illustrated in FIGS. 2C, 2D and 2E, the third leg portion 155C includes a third leg 156C, a third leg post 157C, and a third hole 158B, wherein the third leg post 157C has a third crimp section 159C.

Furthermore, as illustrated in FIG. 2F, when the second leg post 157B is rotatably fitted inside the second handle post 152B, the second slit 153B and the second hole 158B are aligned with one another, and a second screw 160B is inserted through the second slit 153B and the second hole 158B. As illustrated in FIG. 2F, when the third leg post 157C is rotatably fitted inside the third handle post 152C, the third slit 153C and the third hole 158C are aligned with one another, and a third screw 160C is inserted through the third slit 153C and the third hole 158C.

Returning to FIG. 1A, the assembled first handle portion 150A and first leg portion 155A are disposed within the first handle recess 140A and the first channel 145A. The first handle 151A is nested in the first handle recess 140A while the first handle post 152A and the first leg post 157A are disposed within the first channel 145A. The first leg 156A extends out from the opening of the first channel 145A at the lower side 115.

Similarly assembled second handle portion 150B and second leg portion 155B are disposed within the second handle recess 140B and the second channel 145B. The second handle 151B is nested in the second handle recess 140B while the second handle post 152B and the second leg post 157B are disposed within the second channel 145B. The second leg 156B extends out from the opening of the second channel 145B at the lower side 115.

Next, FIG. 1B illustrates an example barricade system 100 as viewed from the second surface 135. The same reference numerals as in FIG. 1A denote the same parts in FIG. 1B, and a detailed description thereof will be omitted. The second surface 135 includes a third handle recess 140C. Similar to the first handle recess 140A, the third handle recess 140C may have an elongated shape that is parallel with the upper side 110 and the lower side 115.

A third channel 145C has an opening at the lower side 115. The third channel 145C extends from the lower side 115 toward the upper side 110 to the third handle recess 140C. The third channel 145C may be parallel with the first lateral side 120 and the second lateral side 125. The third channel 145C connects with the third handle recess 140C. The third channel 145C and the third handle recess 140C may be perpendicularly connected with each other. Similar to that of the first channel 145A, the third channel 145C mat be connected to a mid-point of the third handle recess 140C in a longitudinal direction, but the connecting point is not limited to the mid-point of the third handle recess 140C in a longitudinal direction, and the connecting point may be anywhere in the third handle recess 140C.

As illustrated in FIG. 1B, the assembled third handle portion 150C and third leg portion 155C are disposed within the third handle recess 140C and the third channel 145C. The third handle 151C is nested in the third handle recess 140C while the third handle post 152C and the third leg post 157C are disposed within the third channel 145C. The third leg 156C extends out from the opening of the third channel 145C at the lower side 115.

FIGS. 1A and 1B illustrate the first handle recess 140A, the second handle recess 140B, and the third handle recess 140C are disposed so that each of the first handle recess 140A, the second handle recess 140B, and the third handle recess 140C does not overlap with the other two handle recesses. However, it is not limited to a non-overlapping manner, and a portion of the third handle recess 140C may overlap with a portion of at least one of the first handle recess 140A and the second handle recess 140B.

Figure 3A:
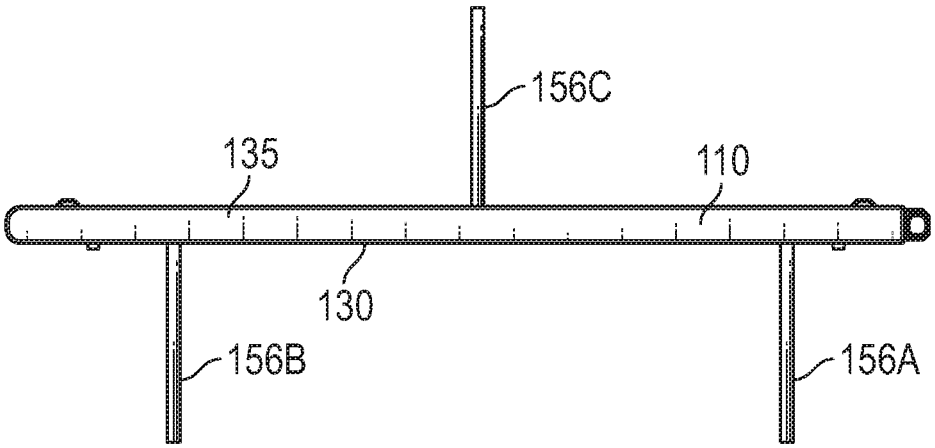
FIGS. 3A, 3B, and 3C illustrate a deployed state of the barricade system according to certain aspects of the disclosure.
Figure 3B:
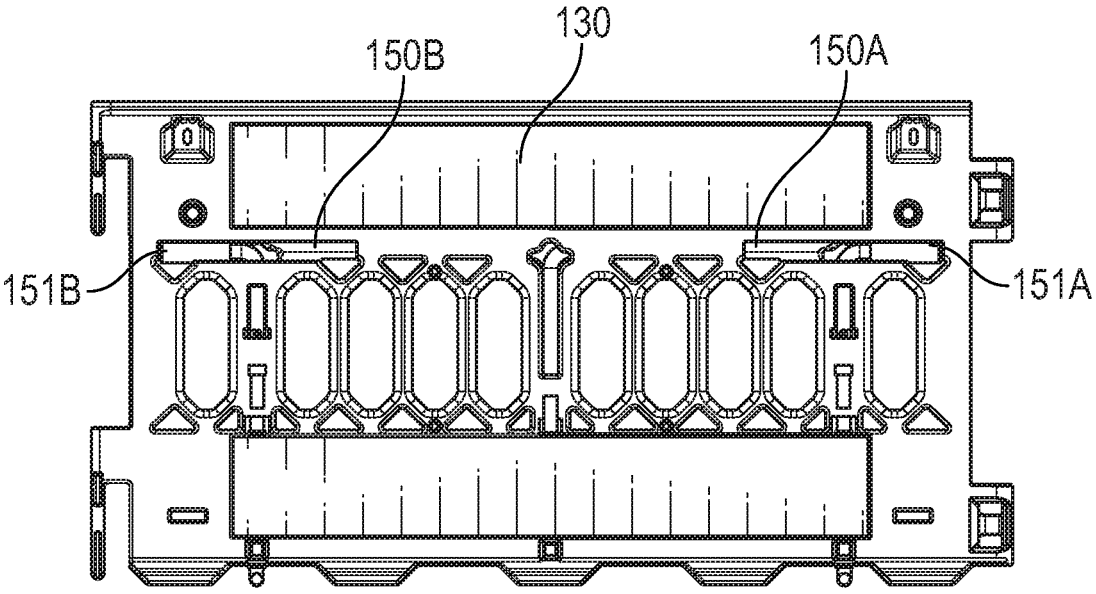
Figure 3C:
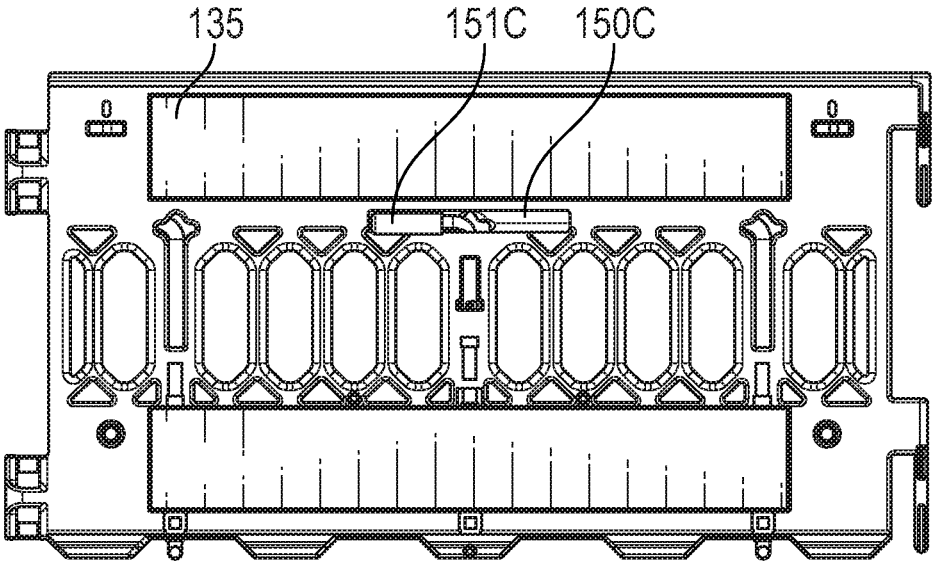

FIGS. 3A, 3B, and 3C illustrate a deployed state of the barricade system 100. FIG. 3A illustrates the barricade system 100 in the deployed state in a plan view. When the barricade system 100 is in the deployed state, the first leg 156A, the second leg 156B, and the third leg 156C extend outward. For example, when viewed from the upper side 110 towards the lower side 115, the first leg 156A and the second leg 156B extend perpendicularly from the first surface 130, and the third leg 156C extends perpendicularly from the second surface 135. The first handle 151A, the second handle 151B, and the third handle 151C are nested in the respective first, second, and third handle recesses 150A, 150B, and 150C.

FIG. 3B illustrates the barricade system 100 in the deployed state as viewed from the first surface 130. In the deployed state, the first handle 151A is nested in the first handle recess 150A such that the first handle 151A occupies a first half of the first handle recess 150A. Similarly, the second handle 151B is nested in the second handle recess 150B such that the second handle 151B occupies a first half of the second handle recess 150B.

FIG. 3C illustrates the barricade system 100 in the deployed state as viewed from the second surface 135. In the deployed state, the third handle 151C is nested in the third handle recess 150C such that the third handle 151C occupies a first half of the third handle recess 150C.

Figure 4A:
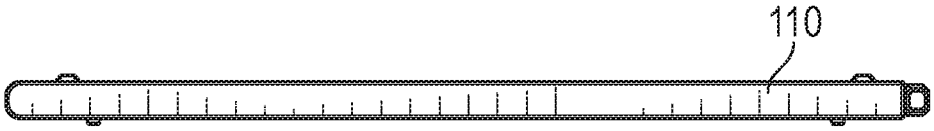
FIGS. 4A, 4B, and 4C illustrate a stowed state of the barricade system according to certain aspects of the disclosure.
Figure 4B:
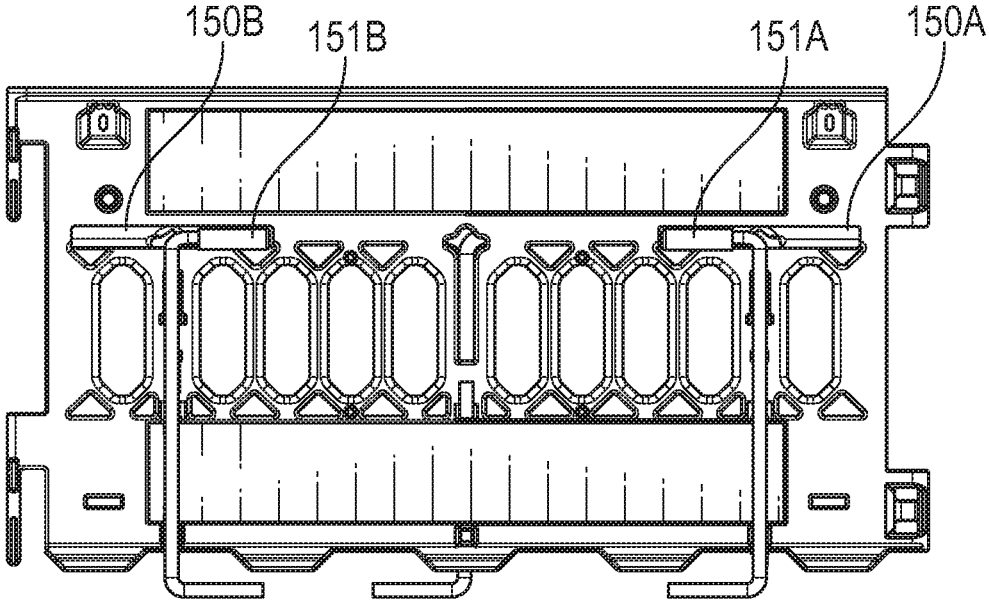
Figure 4C:
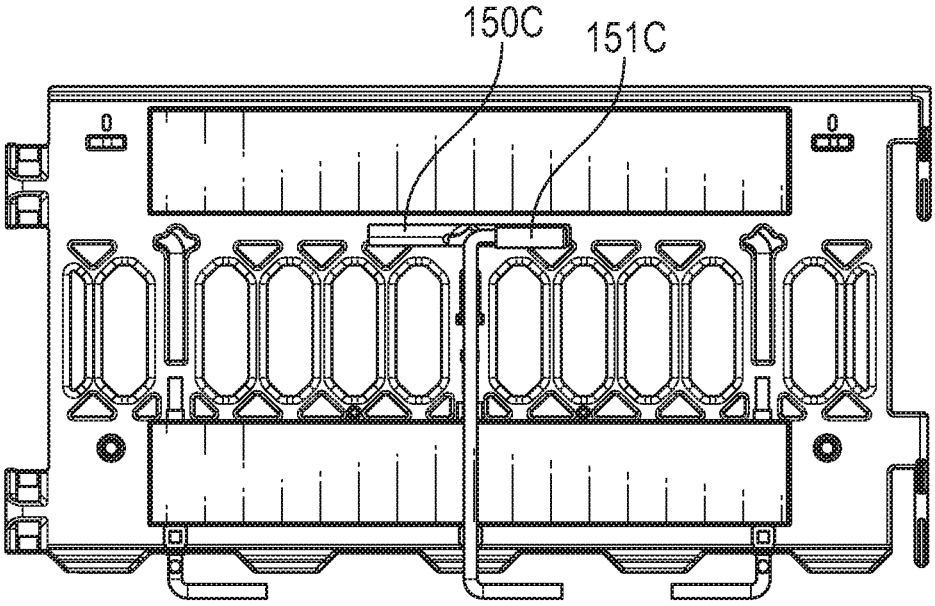

FIGS. 4A, 4B, and 4C illustrate a stowed state of the barricade system 100. FIG. 4A illustrates the barricade system 100 in the stowed state in a plan view. When the barricade system 100 is in the stowed state, the first leg 156A, the second leg 156B, and the third leg 156C align with the upper side 110 and the lower side 115 such that the first leg 156A, the second leg 156B, and the third leg 156C do not extend perpendicularly from the first surface 130 and the second surface 135 when viewed from the upper side 110 toward the lower side 115.

FIG. 4B illustrates the barricade system 100 in the stowed state as viewed from the first surface 130. In the stowed state, the first handle 151A is nested in the first handle recess 150A such that the first handle 151A occupies a second half of the first handle recess 150A. Similarly, the second handle 151B is nested in the second handle recess 150B such that the second handle 151B occupies a second half of the second handle recess 150B.

FIG. 4C illustrates the barricade system 100 in the stowed state as viewed from the second surface 135. In the stowed state, the third handle 151C is nested in the third handle recess 150C such that the third handle 151C occupies a second half of the third handle recess 150C.

In operation, the barricade system 100 can transition between the stowed state and the deployed state. Initially, the barricade system 100 may be in the stowed state in which the first screw 160A abuts the first longitudinal end 153A-1 of the first slit 153A. The first handle 151A nested in the second half of the first handle recess 150A in the stowed state is pulled out of the first handle recess 150A. Continuing to pull the first handle 151A out of the first handle recess 150A rotates the first handle post 152A separating the first longitudinal end 153A-1 away from the first screw 160A. When the first handle 151A becomes perpendicular to the first surface 130, the second longitudinal end 153A-2 abuts the first screw 160A. Continuing to rotate the first handle 151A to be nested into the first half of the first handle recess 150A allows the second longitudinal end 153A-2 to push the abutting first screw 160A in the rotational direction. The rotational force from the rotation of the first handle 151A translates to the first leg portion 155A via the first screw 160A. The first leg 156A, therefore, is deployed such that the first leg 156A extends perpendicularly with respect to the first surface 130. The mechanism utilized in the transitions between the stowed state and the deployed state in the second handle portion 150B and the second leg portion 155B and in the third handle portion 150C and the third leg portion 155C are similar to that of the first handle portion 150A and the first leg portion 155A, and thus, a description thereof will be omitted.

Figure 5A:
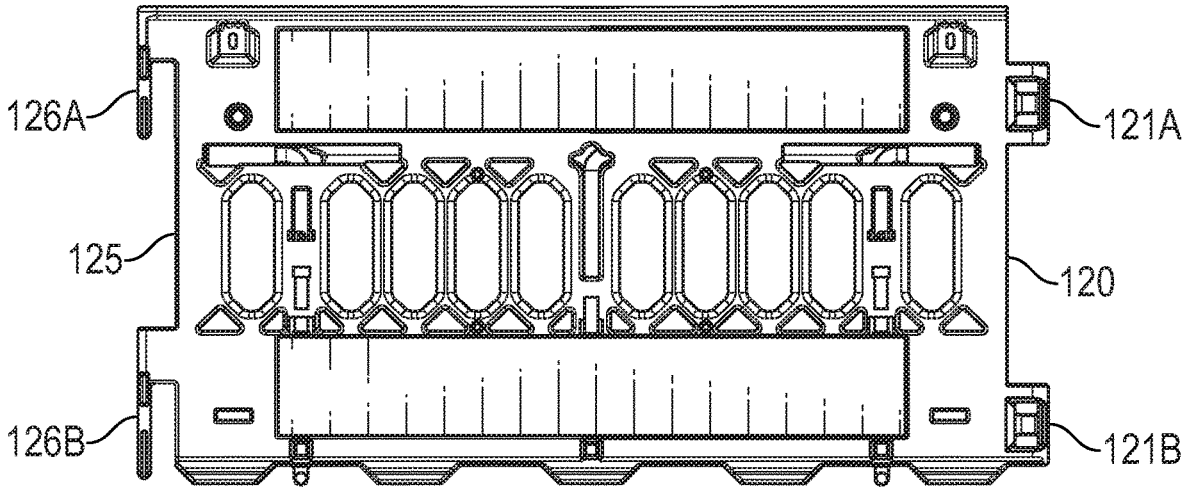
FIG. 5A illustrates an example barricade system according to certain aspects of the disclosure.
Figure 5B:
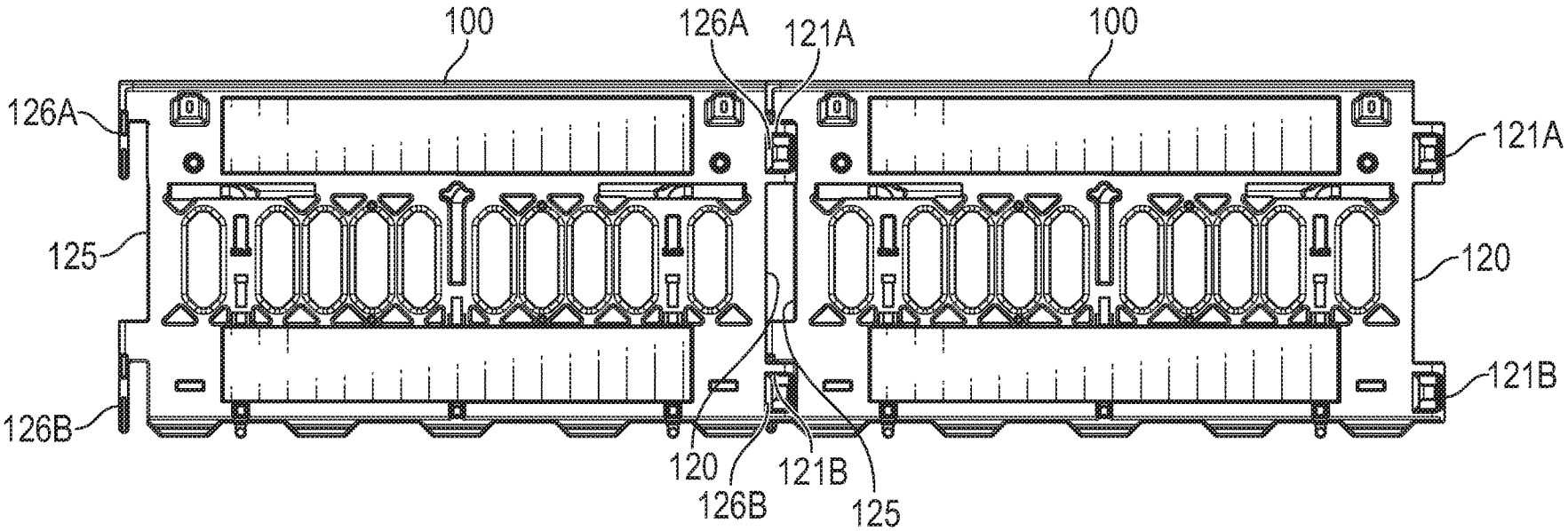
FIG. 5B illustrates an example barricade system engagement according to certain aspects of the disclosure.

FIG. 5A illustrates an example barricade system 100 according to certain aspects of the disclosure. The first lateral side 120 includes engagement element receptacles 121A and 121B. The second lateral side 125 includes pins 126A and 126B that extend downward. FIG. 5B illustrates an example barricade system engagement according to certain aspects of the disclosure. When a first barricade system 100 engages a second barricade system 100, the engagement element receptacles 121A and 121B of the first barricade system 100 engage with the pins 126A and 126B of the second barricade system 100, respectively. In operation, when a first barricade system 100 engages a second barricade system 100, the engagement element receptacles 121A and 121B of the first barricade system 100 receive the pins 126A and 126B of the second barricade system 100.

Figure 6A:
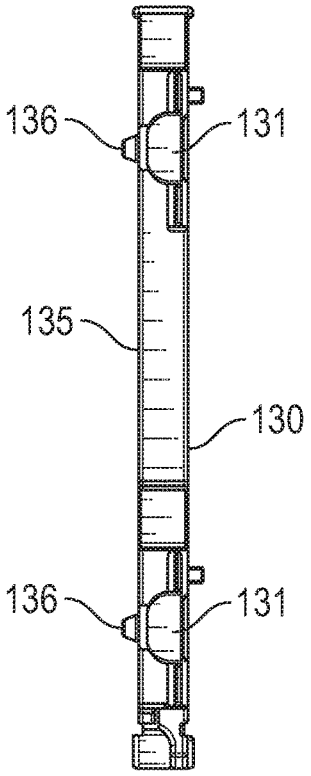
FIG. 6A illustrates a side view of an example barricade system according to certain aspects of the disclosure.
Figure 6B:
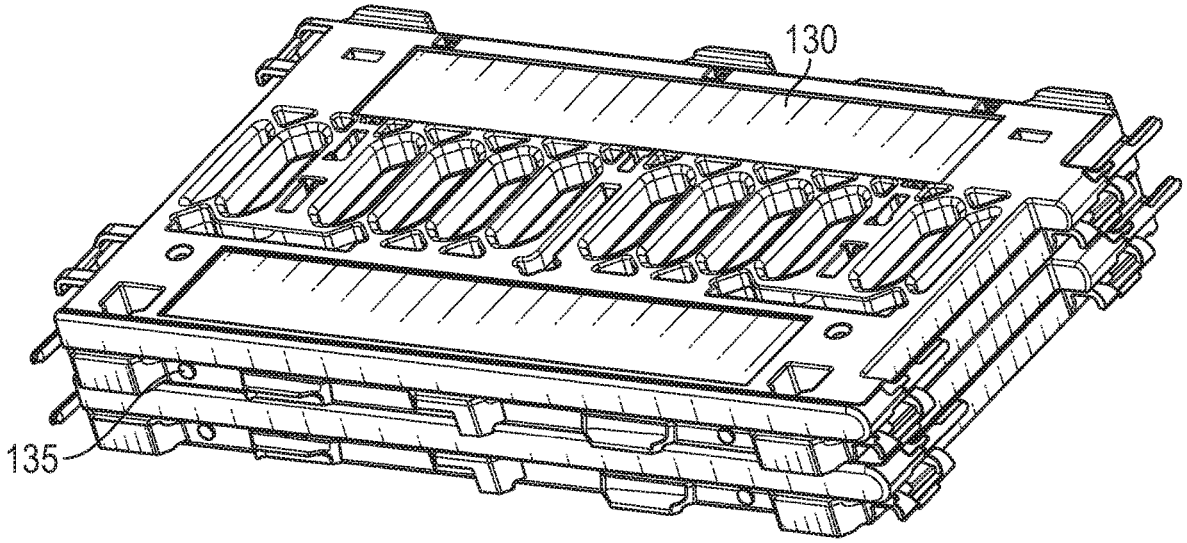
FIG. 6B illustrates an example storage configuration of barricade system according to certain aspects of the disclosure.

FIG. 6A illustrates an example storage configuration of barricade system 100 according to certain aspects of the disclosure. The first surface 130 includes stacking cavities 131, and the second surface 135 includes stacking protrusions 136. As will be described below in further detail with respect to FIG. 6B, multiple barricade systems 100 can be horizontally stacked when the barricade systems 100 are in a stowed state. When a first barricade system 100 and a second barricade system 100 are horizontally stacked, the stacking protrusions 136 on the second surface 135 of the first barricade system 100 can be disposed at least partially within the stacking cavities 131 on the first surface 130 of the second barricade system 100 to facilitate secure and stable stacking of the barricade systems 100. The stacking cavities 131, while not shown, are cavities sized similarly to the stacking protrusions 136 and positioned on corresponding first surface 130 locations as the second surface 135 locations occupied by the stacking protrusions 136.

In some embodiments, the upper side 110 may be a wide handrail having a predetermined width (e.g., 3 inches). For example, the width of the upper side 110 may wider than the width between the first surface 130 and the second surface 135. The stacking cavities 131 and the stacking protrusions 136 are designed so that the barricade systems 100 can be alternately stacked to allow the wide handrail to nest so that the total height of the stack becomes less than the total sum of the widths of the wide handrail of the barricade systems 100. For example, if the width of the wide handrail is 3 inches, the total height of five barricade systems 100 when stacked alternately would be 12.5 inches instead of the total sum of the wind handrails of the five barricade systems 100 which would be 15 inches. This allows more barricade systems 100 to be loaded in a storage space, such as a truck.

Additionally, in some implementations, the barricade system 100 can be formed, or blow-molded, from high-density polyethylene. The elements of this disclosure can be formed of any number of polymers, rubbers, foams, metals, metal alloys, ceramics, woods or any other suitable material known to those skilled in the art. In blow-molded implementations, slugs can be formed by "pinch-offs" in the blow mold used for the barricade system 100. These slugs can be trimmed away to create the first to third handle recesses 140A-140C and the first to third channels 145A-145C. Such a process requires no drilling and allows the barricade system 100 to define a continuous, sealed and waterproof cavity therein. Such a continuous cavity could also hold ballast (such as water or sand) if desired.

In some implementations, the color of the barricade systems 100 may be orange or white. To minimize the damages from the weather, the barricade systems 100 may be made of UV resistant materials or coating.

The size of a barricade system 100 is, for example, 38 inches in height, 3 inches in depth, and 72 inches in length. The weight without the leg portions and the handle portions may be approximately 18.5 pounds.

While some implementations have been illustrated and described, numerous modifications come to mind without significantly departing from the spirit of the disclosure, and the scope of protection is only limited by the scope of the accompanying claims. Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The subject matter of this specification has been described in terms of particular aspects, but other aspects can be implemented and are within the scope of the following claims. For example, while operations are depicted in the drawings in a particular order, this should not be understood as requiring that such operations be performed in the particular order shown or in sequential order, or that all illustrated operations be performed, to achieve desirable results. The actions recited in the claims can be performed in a different order and still achieve desirable results. As one example, the processes depicted in the accompanying figures do not necessarily require the particular order shown, or sequential order, to achieve desirable results. In certain circumstances, multitasking and parallel processing may be advantageous. Moreover, the separation of various system components in the aspects described above should not be understood as requiring such separation in all aspects, and it should be understood that the described program components and systems can generally be integrated together in a single product or packaged into multiple products.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of or" consist of the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each article of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A barricade system comprising:

an upper side;

a lower side disposed opposite the upper side;

a first lateral side extending between the upper side and the lower side;

a second lateral side extending between the upper side and the lower side, the second lateral side disposed opposite the first lateral side;

a first surface extending between the first lateral side and the second lateral side;

a second surface extending between the first lateral side and the second lateral side, the second surface disposed opposite the first surface;

a first handle recess disposed on the first surface;

a first channel extending from an opening at the lower side toward the upper side to the first handle recess, the first channel being parallel with at least one of the first lateral side and the second lateral side;

a first handle portion including a first handle and a first handle post, the first handle extending perpendicularly from one end of the first handle post; and a first leg portion including a first leg and a first leg post, the first leg extending perpendicularly from one end of the first leg post, wherein the first handle post and the first leg post are rotatably connected to each other, wherein the rotatably connected first handle post and first leg post are disposed within the first channel, wherein the barricade system switches between a stowed state and a deployed state by rotating the first handle post 180 degree, and wherein the 180 degree rotation of the first handle post facilitates a 90 degree rotation of the first leg post.

2. The barricade system of claim 1, wherein when the barricade system is in the stowed state:

the first handle is nested in the first handle recess on the first surface such that the first handle is 1) parallel with at least one of the upper side and the lower side, 2) parallel with at least one of the first surface and the second surface, and 3) perpendicular to at least one of the first lateral side and the second lateral side; and the first leg is nested underneath the lower side such that the first leg is parallel with at least one of the first surface and the second surface, and wherein when the barricade system is in the deployed state:

the first handle is nested in the first handle recess on the first surface such that the first handle is 1) parallel with at least one of the upper side and the lower side, 2) parallel with at least one of the first surface and the second surface, and 3) perpendicular to at least one of the first lateral side and the second lateral side; and the first leg is deployed such that the first leg is perpendicular to at least one of the first surface and the second surface.

3. The barricade system of claim 1, wherein the first handle post comprises an elongated slit, wherein the first leg post comprises a hole that receives a screw, wherein when the first handle post and the first leg post are rotatably connected to each other, the elongated slit of the first handle post and the hole of the first leg post are aligned to allow a screw to be inserted through the elongated slit and the hole.

4. The barricade system of claim 3, wherein the first handle post rotates 90 degrees about the first leg post, wherein a first end of the elongated slit abuts the screw in the hole before the first handle post rotates 90 degrees about the first leg post, wherein after the first handle post rotates 90 degrees about the first leg post, the first end of the elongated slit separates from the screw and a second end of the elongated slit abuts the screw, and wherein the second end of the elongated slit is disposed opposite the first end of the elongated slit.

5. The barricade system of claim 4, wherein when the barricade system switches between the stowed state and the deployed state, 1) the first leg post does not rotate during a first half of the 180 degree rotation of the first handle post and 2) the first leg post rotates with the first handle post during a second half of the 180 degree rotation of the first handle post.

6. The barricade system of claim 1, wherein the first handle comprises a first end and a second end opposite the first end, wherein the first end is connected to the one end of the first handle post, wherein when the barricade system is in the stowed state, the second end of the first handle faces the first lateral side, and wherein when the barricade system is in the deployed state, the second end of the first handle faces the second lateral side.

7. The barricade system of claim 6, wherein the first leg comprises a first end and a second end opposite the first end, wherein the first end of the first leg is connected to the one end of the first leg post, wherein when the barricade system is in the stowed state, the second end of the first handle faces the first lateral side while the second end of the first leg faces the first lateral side, and wherein when the barricade system is in the deployed state, the second end of the first handle faces the second lateral side while the second end of the first leg faces away from the first surface.

8. The barricade system of claim 1, further comprising:

a second handle recess disposed on the first surface;

a second channel extending from an opening at the lower side toward the upper side to the second handle recess, the second channel being parallel with at least one of the first lateral side and the second lateral side;

a second handle portion including a second handle and a second handle post, the second handle extending perpendicularly from one end of the second handle post; and a second leg portion including a second leg and a second leg post, the second leg extending perpendicularly from one end of the second leg post, wherein the second handle post and the second leg post are rotatably connected to each other, wherein the rotatably connected second handle post and second leg post are disposed within the second channel, wherein the barricade system switches between the stowed state and the deployed state by rotating the second handle post 180 degree, and wherein the 180 degree rotation of the second handle post facilitates a 90 degree rotation of the second leg post.

9. The barricade system of claim 8, further comprising:

a third handle recess disposed on the second surface;

a third channel extending from an opening at the lower side toward the upper side to the third handle recess, the third channel being parallel with at least one of the first lateral side and the second lateral side;

a third handle portion including a third handle and a second third handle post, the third handle extending perpendicularly from one end of the third handle post; and a third leg portion including a third leg and a third leg post, the third leg extending perpendicularly from one end of the third leg post, wherein the third handle post and the third leg post are rotatably connected to each other, wherein the rotatably connected third handle post and third leg post are disposed within the third channel, wherein the barricade system switches between the stowed state and the deployed state by rotating the third handle post 180 degree, and wherein the 180 degree rotation of the third handle post facilitates a 90 degree rotation of the third leg post.

10. The barricade system of claim 9, wherein when the barricade system is in the stowed state:

the first handle is nested in the first handle recess on the first surface such that the first handle is 1) parallel with at least one of the upper side and the lower side, 2) parallel with at least one of the first surface and the second surface, and 3) perpendicular to at least one of the first lateral side and the second lateral side;

the second handle is nested in the second handle recess on the first surface such that the second handle is 1) parallel with at least one of the upper side and the lower side, 2) parallel with at least one of the first surface and the second surface, and 3) perpendicular to at least one of the first lateral side and the second lateral side;

the third handle is nested in the third handle recess on the second surface such that the third handle is 1) parallel with at least one of the upper side and the lower side, 2) parallel with at least one of the first surface and the second surface, and 3) perpendicular to at least one of the first lateral side and the second lateral side; and each of the first leg, the second leg, and the third leg is nested underneath the lower side such that the first leg is parallel with at least one of the first surface and the second surface.

11. The barricade system of claim 10, wherein when the barricade system is in the deployed state:

the first handle is nested in the first handle recess on the first surface such that the first handle is 1) parallel with at least one of the upper side and the lower side, 2) parallel with at least one of the first surface and the second surface, and 3) perpendicular to at least one of the first lateral side and the second lateral side;

the second handle is nested in the second handle recess on the first surface such that the second handle is 1) parallel with at least one of the upper side and the lower side, 2) parallel with at least one of the first surface and the second surface, and 3) perpendicular to at least one of the first lateral side and the second lateral side;

the third handle is nested in the third handle recess on the second surface such that the third handle is 1) parallel with at least one of the upper side and the lower side, 2) parallel with at least one of the first surface and the second surface, and 3) perpendicular to at least one of the first lateral side and the second lateral side, wherein the first leg is perpendicular to the first surface and the second surface and extends from the first surface, wherein the second leg is perpendicular to the first surface and the second surface and extends from the first surface, wherein the third leg is perpendicular to the first surface and the second surface and extends from the second surface.

12. The barricade system of claim 1, wherein the first lateral side comprises an engagement element, wherein the second lateral side comprises an engagement element receptacle, and wherein when adjoining the barricade system to an adjacent barricade system, 1) the engagement element receptacle of the barricade system receives an engagement element of the adjacent barricade system or 2) an engagement element receptacle of the adjacent barricade system receives the engagement element of the barricade system.

13. The barricade system of claim 12, wherein the engagement element comprises a pin extending downward toward the lower side of the barricade system.

14. The barricade system of claim 13, wherein the engagement element receptacle comprises a receptacle port for receiving a pin of the engagement element of the adjacent barricade system.

15. The barricade system of claim 14, wherein when the barricade system and the adjacent barricade system are engaged, the receptacle port receives the pin of the engagement element of the adjacent barricade system from an upper side of the engagement element receptacle.

* * * * *